US006094125A

United States Patent [19]

Ito

[11] Patent Number: 6,094,125

[45] Date of Patent: Jul. 25, 2000

[54] THIN METAL PLATE STACK ASSEMBLY AND METHOD OF MAKING THE SAME

[75] Inventor: Kunio Ito, Kanagawa-ken, Japan

[73] Assignee: Wako Seiki Co., Ltd., Kanagawa-Ken, Japan

[21] Appl. No.: 09/353,456

[22] Filed: Jul. 14, 1999

[30] Foreign Application Priority Data

Jul. 16, 1998 [JP] Japan ..... 10-201499

[51] Int. Cl.[7] ..... H01F 27/24

[52] U.S. Cl. ..... 336/234; 336/217; 336/232

[58] Field of Search ..... 336/216, 213, 336/217, 234, 200, 210, 232

[56] References Cited

U.S. PATENT DOCUMENTS

| | | | |
|---|---|---|---|
| 4,897,916 | 2/1990 | Blackburn | 29/609 |
| 4,963,849 | 10/1990 | Kowalczyk et al. | 335/201 |
| 5,338,996 | 8/1994 | Yamamoto | 310/217 |
| 5,406,243 | 4/1995 | Jenkins et al. | 336/217 |

FOREIGN PATENT DOCUMENTS

| | | | |
|---|---|---|---|
| 96-809 | 12/1983 | European Pat. Off. | 336/217 |
| 56-112703 | 9/1981 | Japan | 336/217 |

*Primary Examiner*—Michael L. Gellner
*Assistant Examiner*—Anh Mai
*Attorney, Agent, or Firm*—BakerBotts, LLP

[57] ABSTRACT

A thin plate stack assembly formed by stacking a plurality of metallic thin plates and connecting the thin plates to one another, wherein each thin plate comprises a slit and formed leaf which is formed by press working to downwardly slit and form a partial area which is surrounded by an outer edge which is a part of the outer periphery of a thin plate, side edges extending by a certain length toward the inside from both ends of the outer edge, and an inner edge connecting the inside ends of the side edges to each other, and which is bent obliquely downward from said thin plate at the location of said inner edge. The side edges are cut from the thin plate, and a slit and formed hole formed behind the slit and formed leaf, and the slit and formed leaf of each thin plate is inserted into the slit and formed hole in a thin plate disposed just under the thin plate in force fitting for connecting the upper and lower thin plates to each other.

11 Claims, 6 Drawing Sheets

THIN METAL PLATE STACK ASSEMBLY AND METHOD OF MAKING THE SAME

BACKGROUND OF THE INVENTION

1. Field of the Invention

The present invention relates to a thin plate stack assembly formed by stacking a plurality of metallic thin plates and connecting the thin plates to one another, for example, a thin plate stack assembly which can be used as a core for transformer, etc., and a process of manufacture thereof.

2. Description of the Related Art

Up to now, thin plate stack assemblies wherewith a number of metallic thin plates are stacked, being connected to one other, are known. Such thin plate stack assemblies are used for various applications, such as a core for transformer, etc. With conventional thin plate stack assemblies, upper and lower thin plates are connected to each other by various methods, and one of the connecting methods, which is known, is, as shown in FIG. 12, to form a protrusion 4 in the same location of each metallic thin plate 1 which is circular when viewed from above in the figure, having a convex portion 2 on the upper surface side and a concave portion 3 on the lower surface side, by deforming each metallic thin plate 1 so that it has an upward protrusion, and insert the convex portion 2 of each thin plate 1 into the concave portion 3 of a thin plate 1 disposed just above it so that the convex portion 2 bites into the concave portion 3 to connect vertically stacked thin plates 1 to one other. According to such a connecting method, simply by press working each thin plate 1 to protrude and form the protrusion 4, and thereafter, stacking and pressing them, a thin plate stack assembly having the thin plates 1 connected to one another can be formed, and thus, a large quantity of thin plate stack assemblies can be manufactured simply, inexpensively, and at high speed.

However, the connecting method presents a problem in that thin plates having an extremely small plate thickness, for example, thin plates with a plate thickness of 0.1 mm cannot be satisfactorily connected to one another.

In other words, the protrusion 4 in the method is formed, as shown in FIG. 13, by using a punch 5 having a circular cross section and a die 7 having a hole portion 6 with a circular cross section which corresponds to the cross-sectional geometry of the punch 5, and as illustrated, pressing the punch 5 against the thin plate 1 to protrude a part of the thin plate 1. However, in this case, if the diameter D2 of the hole portion of the die is made too large for the diameter D1 of the punch cross section, the diameter of the convex portion 2 on the upper surface side becomes too large compared to the diameter of the concave portion 3 on the lower surface side, resulting in it being impossible to insert the convex portion 2 into the concave portion 3. The diameter D2 of the hole portion of the die is therefore set at a value slightly larger than the diameter D1 of the punch cross section so that, in stacking, the convex portion 2 is inserted into the concave portion 3 with sufficient force for the convex portion 2 biting into the concave portion 3 to connect the thin plates 1 to one another.

Resulting from the diameter D2 of the hole portion of the die thus being set at a value slightly larger than the diameter D1 of the punch cross section, increasing the amount of protrusion, P, can cause cracks to initiate in the peripheral edge potion 4*a* of the protrusion 4, and thus, generally, the upward protrusion can be formed to at most approximately half of the plate thickness t. For this reason, as the plate thickness is decreased, the amount of upward protrusion, P, must be decreased. For example, when the plate thickness is 0.1 mm, the amount of protrusion, P, must be at most 0.05 mm, and with such a degree of amount of protrusion, satisfactory biting into the concave portion 3 of a thin plate disposed just above cannot be provided, which makes it difficult to obtain the required connecting force. In other words, with a thin plate having an extremely small plate thickness, such as a thin plate with a plate thickness of 0.1 mm, a problem is presented where it is difficult to connect the thin plates to one another using such a connecting method.

The purpose of the present invention, taking the above-stated situation into consideration, is to provide a thin plate stack assembly which can be favorably and simply produced by connecting thin plates, if they have an extremely small plate thickness, and a process of manufacture thereof.

SUMMARY OF THE INVENTION

To achieve the above purpose, the thin plate stack assembly according to the present invention is:

a thin plate stack assembly formed by stacking a plurality of metallic thin plates and connecting the thin plates to one another, wherein each thin plate comprises a slit and formed leaf which is formed by press working to downwardly slit and form a partial area including a part of the outer periphery of the thin plate, and a slit and formed hole which is formed behind the slit and formed leaf; and the slit and formed leaf of each thin plate is inserted into the slit and formed hole in a thin plate disposed just under the thin plate for connecting the upper and lower thin plates to each other.

The slit and formed leaf can be a slit and formed leaf which is formed by press working to downwardly slit and form a partial area which is surrounded by an outer edge which is a part of the outer periphery of a thin plate, side edges extending by a certain length toward the inside from both ends of the outer edge, and an inner edge connecting the inside ends of the side edges to each other; and which is bent obliquely downward from the thin plate at the location of the inner edge, the side edges being cut from the thin plate.

The slit and formed leaf can be of a geometry comprising an inclined portion which extends obliquely downward from the location of the inner edge, and a parallel portion which extends roughly in parallel with the thin plate from the lower end of the inclined portion.

The thin plate can have through-holes formed at the locations of the inside ends of the side edges.

The thin plate disposed in the lowermost position of the thin plate stack assembly can have a cutout-like hole into which the slit and formed leaf of a thin plate disposed just above the thin plate is inserted, and need not have the slit and formed leaf.

To achieve the above purpose, the process of manufacture of a thin plate stack assembly according to the present invention is:

a process of manufacture of a thin plate stack assembly formed by stacking a plurality of metallic thin plates and connecting the thin plates to one another, wherein a slit and formed leaf is formed by press working to downwardly slit and form a partial area including a part of the outer periphery of each thin plate; and the slit and formed leaf of each thin plate is inserted into a slit and formed hole formed behind the slit and formed leaf of a thin plate disposed just under the thin plate for connecting the upper and lower thin plates to each other.

The slit and formed leaf can be formed by press working to downwardly slit and form a partial area which is surrounded by an outer edge which is a part of the outer periphery of the thin plate, side edges extending by a certain length toward the inside from both ends of the outer edge, and an inner edge connecting the inside ends of the side edges to each other for cutting the side edges from the thin plate, and bending the partial area obliquely downward from the thin plate at the location of the inner edge.

The slit and formed leaf can be formed in a geometry comprising an inclined portion which extends obliquely downward from the location of the inner edge, and a parallel portion which extends roughly in parallel with the thin plate from the lower end of the inclined portion.

The slit and formed leaf can be formed by forming a through-hole at the locations of the inside ends of the side edges of the thin plate, respectively, and press-working the partial area of the thin plate in which the through-holes are formed.

As a thin plate disposed in the lowermost position of the thin plate stack assembly, a thin plate having a cutout-like hole into which the slit and formed leaf of a thin plate disposed just above the thin plate is inserted, and not having the slit and formed leaf, can be used.

A cutout-like hole in the thin plate disposed in the lowermost position of the thin plate stack assembly can be formed by press working to slit and form the partial area of the thin plate, and then cut it at the location of the inner edge connecting the through-holes to each other for removing the slit and formed leaf.

In the present specification excluding the above section under the title of "Description of the Related Art", the wording "downward" or "downwardly", which is used for a thin plate or a thin plate stack assembly, refers to the direction wherein the slit and formed leaf is protruded, while the wording "upward" or "upwardly" refers to the direction opposite to "downward" or "downwardly", and these are not limited to particular directions related to the direction of gravity.

The thin plate stack assembly and the process of manufacture thereof according to the present invention comprise, as described above, forming a slit and formed leaf in each thin plate by press-working a partial area including a part of the outer periphery of the thin plate to downwardly slit and form it, and inserting the slit and formed leaf of each thin plate into a slit and formed hole produced behind the slit and formed leaf of a thin plate disposed just under the thin plate. The thin plate stack assembly and the process of manufacture thereof according to the present invention utilize the fact that slitting and forming by use of a press provides the width dimension of the slit and formed leaf larger than the width dimension of the slit and formed hole, and that inserting the slit and formed leaf of each thin plate into the slit and formed hole in a thin plate disposed just under the thin plate gives sufficient force for the slit and formed leaf to bite into the slit and formed hole for connection. Thus, if the plate thickness is small, positive biting can be provided for a sufficient connecting force, and the process of manufacture is so simple that the required operations are limited to slitting and forming with a press followed by stacking, and inserting the slit and formed leaf of each thin plate into the slit and formed hole in a thin plate disposed just under it in force fitting, which allows a large quantity of thin plate stack assemblies to be manufactured extremely simply, and at an extremely low cost and high speed.

DESCRIPTION OF THE PREFERRED EMBODIMENTS

Here, preferred embodiments of the present invention will be explained with reference to the accompanying drawings.

Figure 1:
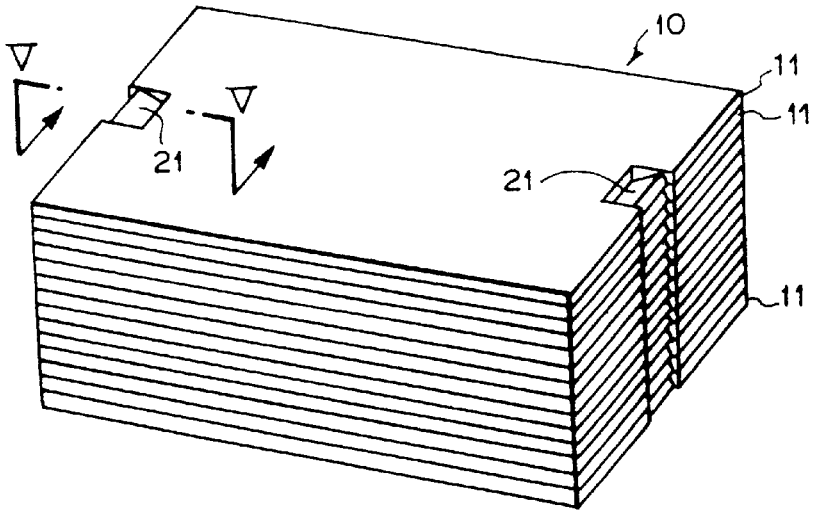
FIG. 1 is a perspective view illustrating a thin plate stack assembly according to an embodiment of the present invention.
Figure 2:
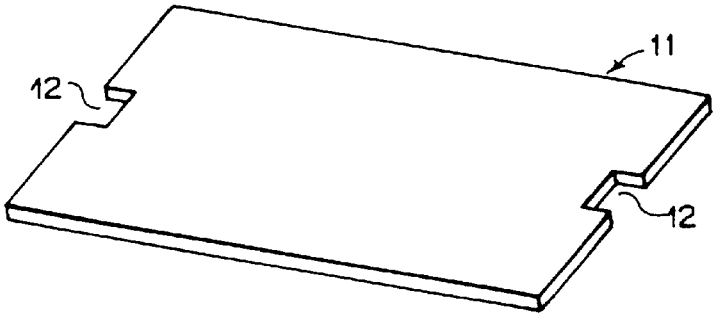
FIG. 2 is a perspective view illustrating a thin plate disposed in the lowermost position of the stack assembly as shown in FIG. 1.
Figure 3:
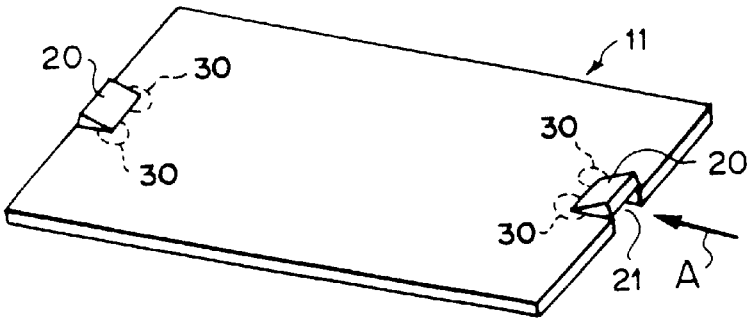
FIG. 3 is a perspective view illustrating a thin plate other than that disposed in the lowermost position of the stack assembly as shown in FIG. 1.
Figure 4:
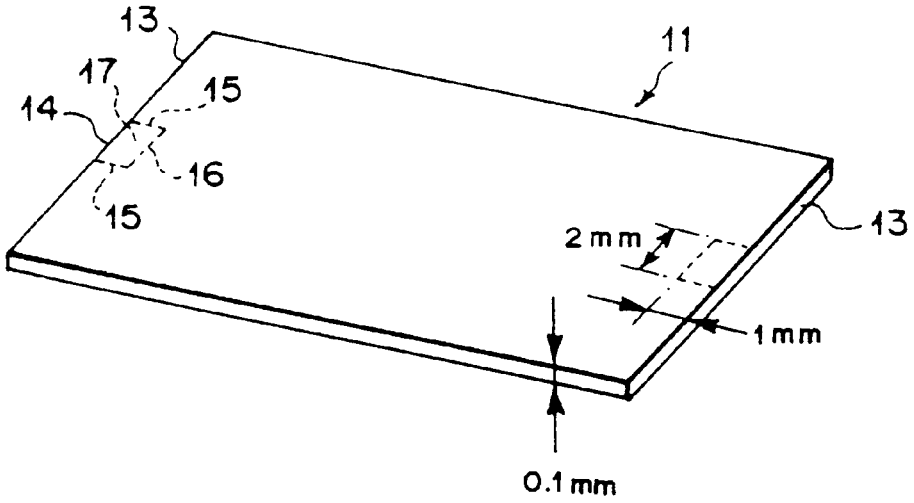
FIG. 4 is a perspective view to explain the working process for the thin plates as shown in FIG. 2 and FIG. 3.

FIG. 1 is a perspective view illustrating a thin plate stack assembly according to an embodiment of the present invention; FIG. 2 is a perspective view illustrating a thin plate disposed in the lowermost position of the stack assembly as shown in FIG. 1; FIG. 3 is a perspective view illustrating a thin plate other than that disposed in the lowermost position of the stack assembly as shown in FIG. 1; and FIG. 4 is a perspective view to explain the working process for the cutout-like hole, slit and formed leaf, and slit and formed hole of each thin plate. In the description of the following embodiments, the "downward" direction corresponds to the direction of gravity, while the "upward" direction corresponds to the direction opposite to that of gravity, and in FIG. 1, FIG. 3, and FIG. 5 to FIG. 10, the upward direction in the figure corresponds to the "downward" one, while the downward direction in the figure corresponds to the "upward" direction (for convenience of explanation, the figures are given with the upward and downward directions being inverted).

A thin plate stack assembly 10 as illustrated is a stack assembly for use as a core for a transformer, being configured by stacking 150 pieces of rectangular thin plate 11 made of a 6.5% silicon steel sheet on top of one upon another. The vertically adjoining thin plates 11 are connected to each other through a later described cutout-like hole, slit and formed leaf, and slit and formed hole. When used as a core for a transformer, the thinner the thin plate 11 of an assembly stack, the higher the efficiency of the transformer, thus, in the present embodiment, thin plates having a plate thickness of 0.1 mm are used.

The thin plate 11 disposed at the lowermost position has a cutout-like hole 12 in the middle of the respective outer periphery portions on the shorter side as shown in FIG. 2.

The cutout-like hole 12 is formed by press working to punch a rectangular partial area 17 which is surrounded by an outer edge 14 which is a part of the outer periphery 13 on the shorter side of the thin plate 11 as shown in FIG. 4, and is located in the middle of the shorter side, having a certain width, side edges 15 which extend inward from both ends of the outer edge 14 by a certain length, and an inner edge 16 connecting the inside ends of the side edges 15 to each other. The dimensions of this partial area 17 are as shown in FIG. 4.

The thin plates 11 other than that disposed in the lowermost position have, as shown in FIG. 3, a slit and formed leaf 20 which is formed by press working to slit and form the partial area 17 obliquely downward, and a slit and formed hole 21 which is formed behind the slit and formed leaf 20. The slit and formed leaf 20 is formed by slitting and forming with a press to cut (shear) the side edges 15 of the partial area 17 from the thin plate 11, and at the same time, bend the partial area 17 obliquely downward from the thin plate 11 at the location of the inner edge 16, and the slit and formed hole 21 is formed in the region where the partial area 17 existed, i.e., behind the slit and formed leaf 20 by slitting and forming the partial area 17.

Figure 5:
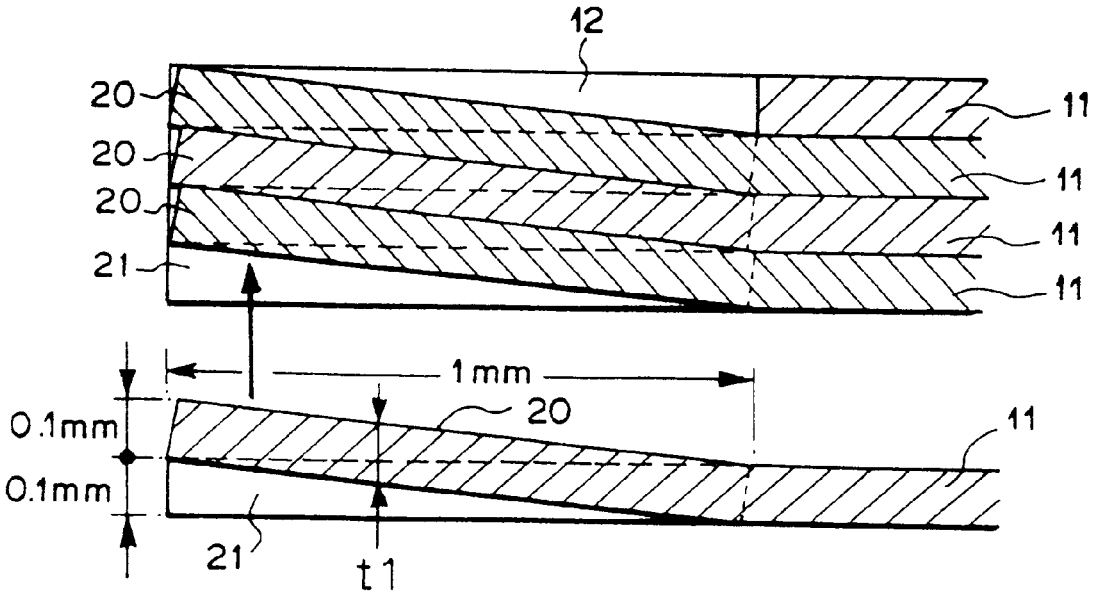
FIG. 5 is a sectional view taken along the line V—V in FIG. 1.

A thin plate stack assembly as shown in FIG. 1 is formed by stacking 150 thin plates 11, 149 thin plates 11 as shown in FIG. 3 wherein a slit and formed leaf 20 is formed, and 1 thin plate 11 as shown in FIG. 2 wherein a cutout-like hole 12 is formed are prepared. The 149 thin plates 11 as shown in FIG. 3 are stacked one on top of the other, and as shown in FIG. 5, the vertically adjoining thin plates 11 are connected to each other by inserting the slit and formed leaf 20 of the upper thin plate 11 into the slit and formed hole 21 in the lower thin plate 11. Under the 149 stacked thin plates 11, the thin plate 11 as shown in FIG. 2 is disposed, and the slit and formed leaf 20 of the thin plate 11 disposed in the lowermost position of the 149 thin plates 11 is inserted into the cutout-like hole 12 in the thin plate 11 under it to connect those thin plates 11 to each other in order to form a thin plate stack assembly wherewith a total of 150 thin plates 11 are stacked and connected. Connection of these thin plates to one another can be made by disposing a thin plate 11 as shown in FIG. 2 in the lowermost position, and on it, stacking and disposing 149 thin plates 11 as shown in FIG. 3, then, pressing the whole in the vertical direction to insert each slit and formed leaf 20 into the slit and formed hole 21 and the cutout-like hole 12.

Figure 6:
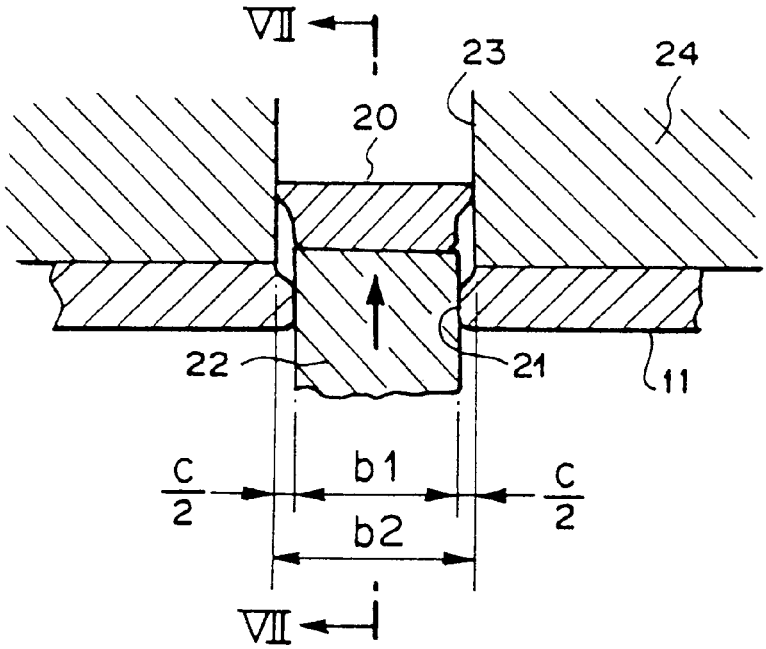
FIG. 6 is a drawing to explain slitting and forming to form a slit and formed leaf.
Figure 7:
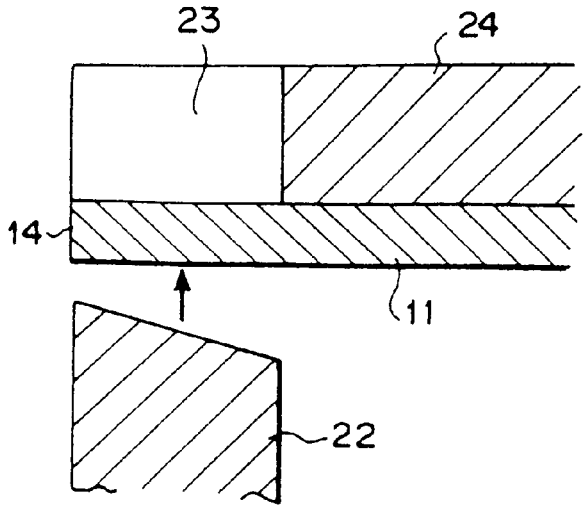
FIG. 7 is a sectional view taken along the line VII—VII in FIG. 6.

Next, the reason why the thin plates 11 are connected to one another by inserting the slit and formed leaf 20 into the slit and formed hole 21 will be described. FIG. 6 is a conceptual drawing when the thin plate 11 is viewed from the direction of arrow A in FIG. 3, illustrating the process wherein the slit and formed leaf 20 and the slit and formed hole 21 are formed by slitting and forming with a press, and FIG. 7 is a conceptual sectional view taken along the VII—VII line in FIG. 6.

As shown in these figures, in slitting and forming, a punch 22 having a certain width b1 and a die 24 having a hole portion 23 with a certain width b2 slightly larger than the width b1 are used, and as illustrated, the punch 22 is pressed against the thin plate 11 to slit and form the partial area 17. In other words, by thrusting down the partial area 17 of the thin plate 11 with the punch 22 to cut (shear) the side edges 15 thereof from the thin plate 11, and at the same time, bend the partial area 17 obliquely downward from the thin plate 11 at the location of the inner edge 16, the slit and formed leaf 20 and the slit and formed hole 21 behind it are formed. The difference c between the width b2 and the width b1 corresponds to a normal clearance between the punch and the die hole which is set in blanking with a press, for example, and is set so that b2=2.01 mm or so when b1=2.0 mm, for example.

When the slit and formed leaf 20 and the slit and formed hole 21 are thus formed, the slit and formed leaf 20 and the slit and formed hole 21 provide a geometry as shown in FIG. 6, respectively. In other words, when the punch having a width b1 is pushed down, being pressed against the thin plate 11, the thin plate 11 is fractured halfway through the plate thickness, which results in the slit and formed leaf 20 and the slit and formed hole 21 both having the punch width b1 on the punch side, while they both have the die hole width b2 on the die side (b2>b1), and thus when the slit and formed leaf 20 is inserted into the slit and formed hole 21, the slit and formed leaf 20 is inserted into the slit and formed hole 21 by force fitting, which results in the slit and formed leaf 20 being connected to the slit and formed hole 21, i.e., the upper thin plate 11 being connected to the lower thin plate 11. Also for the cutout-like hole 12, when a similar punch and a similar die with a hole portion are used to punch the partial area 17 for formation thereof, the width of the cutout-like hole 12 is similar to that of the slit and formed hole 21, and thus, by inserting the slit and formed leaf 20 into the cutout-like hole 12, connection of the thin plates to each other is similarly performed.

With the present embodiment, as a thin plate 11 disposed in the lowermost position, a thin plate having a cutout-like hole 12 is used as stated above, which is because it is taken into account that, if a thin plate 11 as shown in FIG. 3 wherein a slit and formed leaf 20 is formed is used as a thin plate disposed in the lowermost position, the slit and formed leaf 20 of the thin plate disposed in the lowermost position is protruded beyond the bottom of the thin plate stack assembly, and when the protrusion of the slit and formed leaf 20 presents no problem in particular, a thin plate 11 as shown in FIG. 3 having a slit and formed leaf 20 may be used as a thin plate disposed in the lowermost position.

Figure 8:
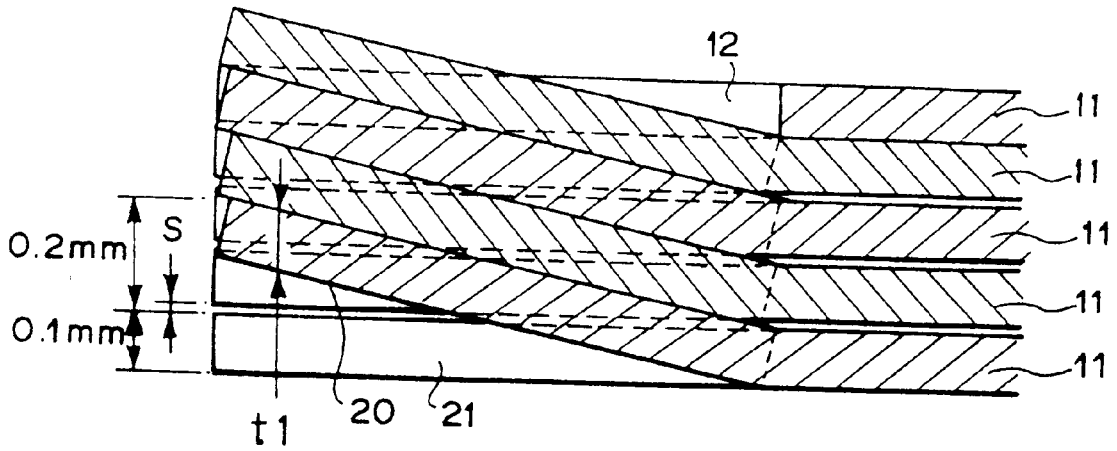
FIG. 8 is a sectional view similar to FIG. 5 of another embodiment.

With the slit and formed leaf 20, as shown in FIG. 5, the thin plate 11 having a plate thickness of 0.1 mm is bent obliquely downward by the same amount as the 0.1 mm, and thus, the slit and formed leaf 20 of the upper thin plate is inserted only into the slit and formed hole 21 in the one thin plate disposed just thereunder for connection thereto. However, the slit and formed leaf 20 must not always be connected only to the slit and formed hole 21 in the one thin plate disposed just thereunder, and as shown in FIG. 8, by increasing the amount of bending to 0.2 mm, for example, it may be connected to the slit and formed holes 21 in the two thin plates disposed just thereunder. However, if the amount of bending is increased, the plate thickness tl in the vertical direction of the slit and formed leaf 20 is also increased accordingly to a value larger than the original plate thickness t=0.1 mm, and a clearance S equal to the amount of increase in thickness is produced between one thin plate 11 and another thin plate 11. Therefore, it is necessary to bend the slit and formed leaf 20 within the range of tolerable clearance S. For the slit and formed leaf 20 as shown in FIG. 5, the plate thickness t1 in the vertical direction is 0.101 mm, compared to the original plate thickness of t=0.1 mm.

Figure 9:
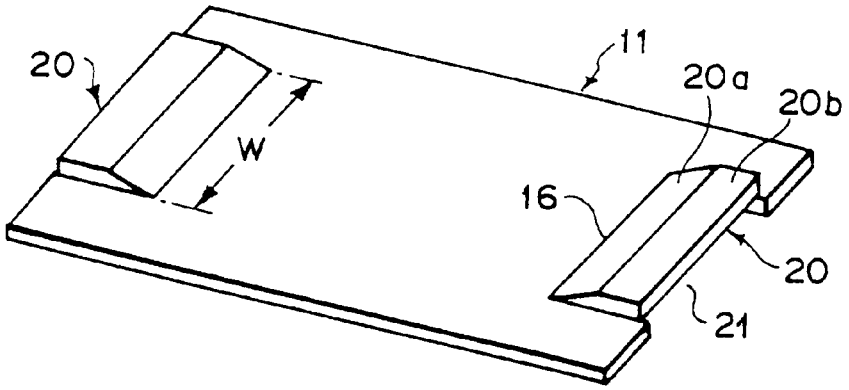
FIG. 9 is a perspective view illustrating a thin plate of another embodiment.
Figure 10:
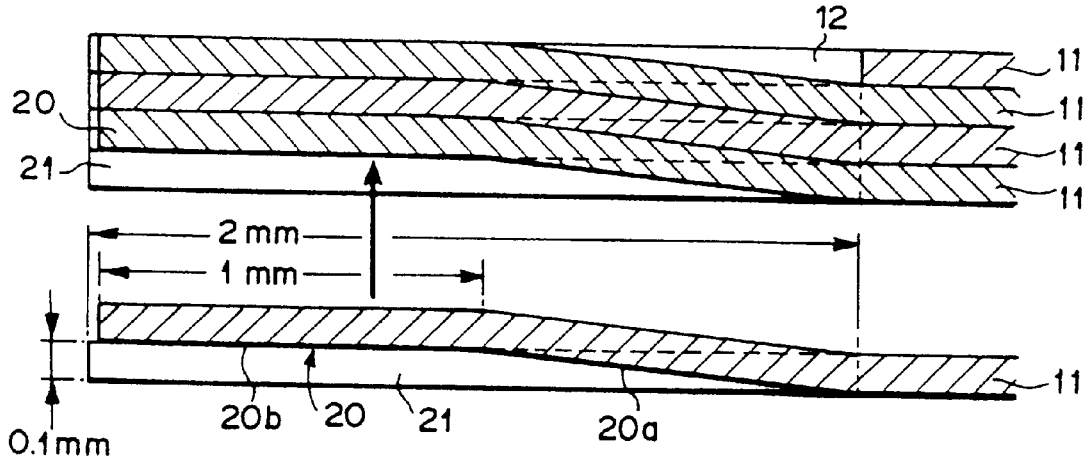
FIG. 10 is a sectional view similar to FIG. 5 in the embodiment using the thin plate as shown in FIG. 9.

Next, with reference to FIG. 9 and FIG. 10, another embodiment will be described. FIG. 9 is a perspective view illustrating a thin plate 11, and FIG. 10 is a sectional view similar to FIG. 5. With the above-stated embodiment, the slit and formed leaf 20 extends linearly in the obliquely downward direction, while with the present embodiment, the slit and formed leaf 20 comprises an inclined portion 20*a* which extends obliquely downward from the location of the inner edge 16, and a parallel portion 20*b* which extends roughly in parallel with the thin plate 11 from the lower end of the inclined portion 20*a*. This slit and formed leaf 20 has a large width W, compared to the slit and formed leaf 20 as shown in FIG. 3, and the length is set at 1 mm for the inclined portion 20*a*, and at 1 mm also for the parallel portion 20*b*.

According to the present embodiment, the slit and formed leaf 20 comprises an inclined portion 20*a* and a parallel portion 20*b*, and the parallel portion 20*b* is protruded downward from the thin plate 11 to be inserted into the slit and formed hole 21 in the thin plate 11 disposed just thereunder. In other words, with the present embodiment, the entire parallel portion 20*b* is inserted into the slit and formed hole 21, and the amount of insertion into the slit and formed hole 21 (the area of the slit and formed leaf 20 disposed inside the slit and formed hole 21 in FIG. 10) is larger than that for the slit and formed leaf 20 as shown in FIG. 3, which allows the connecting force of the thin plate 11 to be increased by the amount corresponding to the difference.

Figure 11:
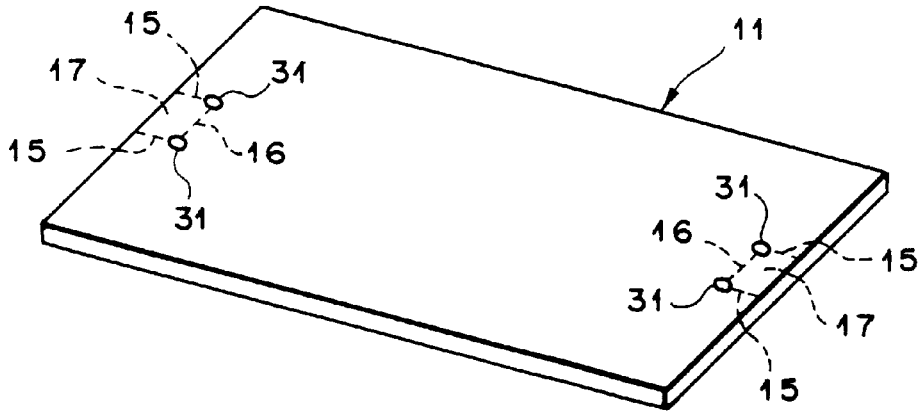
FIG. 11 is a drawing illustrating a thin plate of another embodiment.
Figure 12:
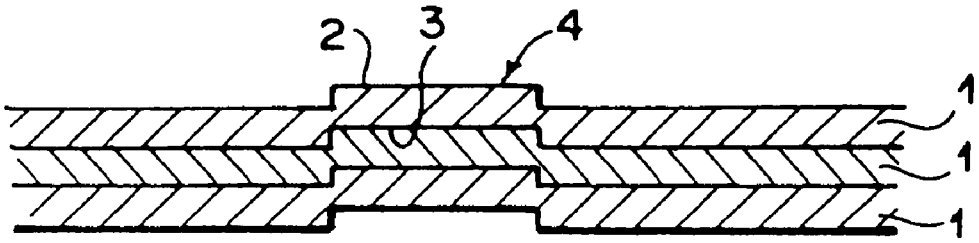
PRIOR ART FIG. 12
FIG. 12 is a sectional view illustrating an example of prior art.
Figure 13:
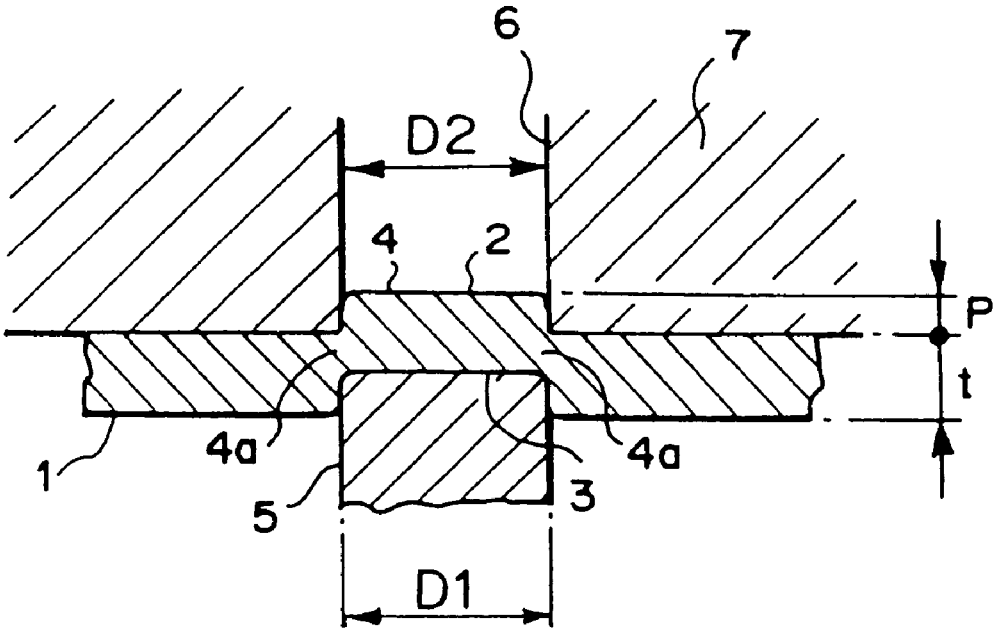
PRIOR ART FIG. 13
FIG. 13 is a drawing to explain the working process for the protruded portion in FIG. 12.

FIG. 11 is a perspective view illustrating a thin plate of a third embodiment. When a slit and formed leaf 20 is formed as stated above, the root corner portion 30 of the slit and formed leaf which is surrounded by a dotted line in FIG. 3 may be deformed, being bulged downward by bending the slit and formed leaf 21 downward, depending upon the material, the plate thickness, the degree of bending of the slit and formed leaf, or other factor. If the root corner portion 30 of the slit and formed leaf is deformed, being bulged, a problem occurs that, when a number of thin plates are stacked, their root corner portions 30 which are bulged are piled one upon another, which results in the overall thickness of the stack assembly 10 being increased with a clearance being produced between thin plates 11.

Then, with the present embodiment, as shown in FIG. 11, through-holes 31 are previously formed at the locations of the inside ends of the side edges 15 of the partial area 17, and the thin plates 11 in which the through-holes 31 are formed are press-worked in a similar manner to that as stated above to form a slit and formed leaf 20. Thus, by previously forming through-holes 31 at the locations of the inside ends of the side edges 15 which correspond to the root corner portions of the slit and formed leaf, downward bulging of the root corner portions 30 resulting from bending of the slit and formed leaf 20 in press-working can be prevented. With the present embodiment, as the through-hole 31, a hole having a circular section of 0.6 mm in diameter is formed, but this through-hole 31 may be of any geometry, and of any dimensions, and formed in any style, so long as the purpose of avoiding the bulging can be achieved.

In addition, if through-holes 31 are formed at the locations of the inside ends of the side edges 15 of the slit and formed leaf, the following advantage can be obtained. In other words, with the above-stated embodiment, a cutout-like hole 12 in the thin plate 11 for use in the lowermost position of the stack assembly is formed by punching with a press. However, if this cutout-like hole 12 is to be formed by punching with a press, formation of the cutout-like hole 12 in the thin plate 11 disposed in the lowermost position and that of the slit and formed leafs 20 in the other thin plates 11 must be performed by different types of press working, and if the slit and formed leafs 20 and the cutout-like hole 12 are thus formed by different types of press working, it is difficult to align the slit and formed leafs 20 with the cutout-like hole 12 with high accuracy. Then, instead of forming the cutout-like hole 12 in the thin plate 11 disposed in the lowermost position by punching with a press, by press-working it in the same way as that for the other thin plates 11 to form a slit and formed leaf 20, and thereafter, cutting it at the location of the inner edge 16 connecting the through-holes 31 to each other, the cutout-like hole 12 is formed. If a cutout-like hole 12 is formed in this way, the cutout-like hole 12 is formed by basically the same type of press working as that for the slit and formed leaf 20, which allows the cutout-like hole 12 and the slit and formed leaf 20 to be easily formed in the same location.

The thin plate stack assembly 10 according to the present invention is not limited to the above-stated embodiments, but can take a variety of modified styles within the range of the gist. For example, the thin plate stack assembly 10 according to the present invention is not limited to that for use as a core for a transformer, but can be used for various other applications. The thin plate 11 which is used is not limited to that made of a silicon steel sheet, but may be made of any material if it is a metallic thin plate. In addition, the plate thickness of the thin plate 11 which is used is not particularly limited, but it may be thinner than 0.1 mm in the embodiments, for example, 0.05 mm, or thicker than 0.1 mm. In addition, the specific working style of slitting and forming with a press to form a slit and formed leaf 20 is not limited to that as given in the embodiments, but various other styles can be adopted, and the geometry of the slit and formed leaf 20, i.e., that of the partial area 17 of the thin plate may be of any geometry so long as it includes a part of the outer periphery of the thin plate 11. Further, with the embodiments as illustrated, one slit and formed leaf 20 is formed in the respective outer peripheries on the shorter sides of the thin plate 11, however, two slit and formed leaves 20 may be formed in the respective outer peripheries on the shorter sides.

What is claimed is:

1. A thin plate stack assembly comprising:

a plurality of thin metallic plates aligned in a stack and connected to each other;

each thin plate having a partially slit portion at an outer periphery providing a leaf extending at an angle away from the plate and a corresponding opening adjacent to the leaf at the outer periphery of the plate; and a leaf of each plate being received in a corresponding opening in an adjacent plate in the assembly in force-fitting relation to connect and to retain the adjacent plates together.

2. A thin plate stack assembly according to claim 1 wherein each leaf has an outer edge which is a part of the other periphery of the plate and has two side edges extending substantially the same distance inwardly from the outer edge and a bent plate portion extending between the inner ends of the side edges and joining the leaf to the remainder of the plate.

3. A thin plate stack assembly according to claim 1 wherein each leaf has an inner portion joined to the remainder of the plate and extending at an angle thereto and an outer portion extending at an angle to the inner portion and substantially parallel to an adjacent portion of the plate to which the inner end is joined.

4. A thin plate stack assembly according to claim 1 wherein the opening has side edges extending inwardly from the outer periphery of the plate and terminating in corresponding through holes in the plate.

5. A thin plate stack assembly according to claim 1 including a further thin plate disposed at one end of the stack containing the plurality of plates and having an opening at an outer peripheral portion and having no corresponding leaf and positioned to receive the leaf of an adjacent plate in force-fitting relation when the plates are assembled in a stack.

6. A process for manufacturing a thin plate stack assembly comprising:

press working each of a plurality of thin plates at an outer periphery thereof to form a partially slit portion providing an opening and a leaf extending at an angle to an adjacent plate portion; and joining the plurality of plates in a stack by assembling the plates with a leaf of each plate being received in force-fitting relation to an opening of an adjacent plate.

7. A process for manufacturing a thin plate stack assembly according to claim 6 comprising forming each leaf by press working a portion of the outer periphery of the corresponding plate to produce spaced slits extending inwardly from the outer periphery and a leaf between the spaced slits which extends at an angle to the remainder of the plate.

8. A process for manufacturing a thin plate stack assembly according to claim 7 wherein each plate is press worked to form a leaf having an inner portion inclined at an angle with respect to the plate and an outer portion inclined at an angle with respect to the inner portion and extending substantially parallel to the remainder of the plate.

9. A process for manufacturing a thin plate stack assembly according to claim 6 including press working a further thin plate at an outer periphery to form an opening without any leaf and assembling the further thin plate at one end of the plurality of thin plates by force-fitting a leaf of an adjacent plate into the opening of the further thin plate.

10. A process for manufacturing a thin plate stack assembly according to claim 9 wherein the opening in the further thin plate has opposed side edges extending inwardly from the periphery and including forming a through hole at the inner end of each side edge of the further thin plate.

11. A process for manufacturing a thin plate stack assembly according to claim 6 wherein the partially slit portion includes two spaced slits extending inwardly from the outer periphery of the plate and including the step of forming a hole at the inner end of each slit.

* * * * *